US006905191B2

(12) United States Patent
Krouss

(10) Patent No.: US 6,905,191 B2
(45) Date of Patent: Jun. 14, 2005

(54) BANDING REDUCTION IN INCREMENTAL PRINTING

(75) Inventor: Paul R. Krouss, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/426,568

(22) Filed: Apr. 30, 2003

(65) Prior Publication Data

US 2003/0202042 A1 Oct. 30, 2003

(30) Foreign Application Priority Data

Apr. 30, 2002 (GB) ..... 0209942

(51) Int. Cl.[7] ..... B41J 2/145; B41J 2/15
(52) U.S. Cl. ..... 347/40
(58) Field of Search ..... 347/9, 12, 16, 347/40, 41

(56) References Cited

U.S. PATENT DOCUMENTS 4,855,752 A * 8/1989 Bergstedt ..... 347/41
5,568,168 A * 10/1996 Watanabe ..... 347/43

FOREIGN PATENT DOCUMENTS

| | | |
|---|---|---|
| EP | 0 827 839 | 3/2002 |
| GB | 2 361 670 | 10/2001 |

* cited by examiner

*Primary Examiner*—Thinh Nguyen
(74) *Attorney, Agent, or Firm*—Foley & Lardner LLP

(57) ABSTRACT

A method of printing with a printer of the type comprising a substantially linear arrangement of parallel pens mounted on a scan axis, each pen comprising an array of ink ejection elements, comprises printing a plurality of swaths, each from a different pen, on a printing medium between successive incremental advances of said medium in a printing advance direction (PAD) relative to the pens wherein said swaths are printed such that the boundaries of at least two of the swaths are offset from one another in the PAD. In a preferred method of the invention, the nozzles of the various pens are divided into active and inactive sets of nozzles, such that only the active nozzles are used to print the swaths and so that the different active nozzle sets each have offset endpoints in the PAD to print offset swath boundaries.

18 Claims, 3 Drawing Sheets

BANDING REDUCTION IN INCREMENTAL PRINTING

CROSS-REFERENCE TO RELATED PATENT APPLICATIONS

GB Priority Application 0209942.2, filed Apr. 30, 2002 including the specification, drawings, claims and abstract, is incorporated herein by reference in its entirety.

FIELD OF THE INVENTION

This invention relates to printing using printers which incrementally advance the printing medium relative to the printhead and more particularly printing methods and printer control software or circuitry for reducing the amount of banding arising from swath printing between advances.

BACKGROUND OF THE INVENTION

Printers such as inkjet printers generally employ printheads which are mounted on a scan axis for printing in a swath across a sheet of a print medium. The print medium, whether or not of paper, may be referred to herein as a "page" for simplicity, although any print-receiving medium is encompassed by this term whether in page format, in the form of an endless web, or in the form of an article such as an envelope which is fed through the printer).

The page is incrementally advanced through the printer in a direction perpendicular to the scan axis (the direction of paper movement is known as the "media axis" or as the printing advance direction ("PAD"), and the two terms are used interchangeably herein). Between each incremental advance a swath of ink is deposited on the paper.

When an image is sent to the printer, the printing software (generally embodied in printer control circuitry) generates an image mask in which the image is split into swaths of a height equal to the height of the printhead. FIG. 1 shows a print carriage of the type used in the Hewlett-Packard Designjet 10 ps, Designjet 20 ps or Designjet 50 ps range of printers. Six print cartridges 10 are mounted on a carriage 12 which travels along a pair of parallel rails 14 defining a scan axis. The carriage is driven by a belt 16 along the scan axis. The belt is driven by a motor mounted within the printer (not shown) and a set of offboard ink reservoirs feed ink to the individual print cartridges 10 via a set of six flexible tubes (not shown) whereby each printhead can be supplied with a different coloured ink (e.g. dark cyan, light cyan, dark magenta, light magenta, yellow and black).

Each print cartridge 10 supplies ink to a printhead or pen 18 comprising a linear array of 300 nozzles (arranged in two parallel staggered rows 20,22 of 150 nozzles each) running in the direction of the media axis. The nozzles in each pen are spaced at intervals of 1/600 of an inch along the media axis, and the pens are spaced apart from one another along the scan axis.

In use the printer software converts images to be printed into an image mask of pixels of the six different colours. High quality colour hues can be printed by an appropriate mix of coloured dots laid alongside or on top of one another. In a 600 dpi (dot per inch) print mode, therefore, each square inch of the image will be pixelated into a 600×600 grid, and each point of the paper will either be left blank or will receive a droplet of ink from one or more of the pens. The manner in which the droplets are laid down is specified in the print mode.

In a low quality but high speed single pass print mode, the image mask is divided into a series of swaths running parallel to the scan axis, each swath having a ½ inch height (assuming 600 dpi quality and a pen comprising 300 active nozzles at a spacing of 1/600 of an inch). The paper advances in ½ inch steps in the printing advance direction (PAD). As each successive ½ inch swath of paper is located under the path of the print carriage, the carriage scans across the scan axis and the individual nozzles within the pens fire in a timed sequence under the control of the printer control circuitry to deposit drops of the relevant coloured inks onto the paper in the positions called for by the image mask.

Thus, whenever a drop of dark cyan ink is specified in this strip, the appropriate nozzle is caused to fire as it passes over that point in the page. The entire ½ inch swath receives its full image in a single pass and the page is then advanced by ½ inch before the adjoining swath is printed.

However, if the paper advance mechanism is not accurate in advancing the paper by ½ inch exactly, there will be either a gap between successive swaths or an overprinting of the bottom rows of one swath and the top rows of the next swath. Generally these errors will be periodic.

Because the darkness or colour saturation between adjacent swaths is not exactly matched another element of banding occurs at the swath interfaces. Ink deposited along the swath boundaries is deposited on a different wetness gradient than ink in the regions between the lines. While this effect is not very pronounced in high pass print modes, there is nevertheless the potential for colour mismatch at the swath boundaries.

Such effects are collectively known as banding errors as they result in printing errors located in periodically repeating bands down the page. The present invention is directed, in part, to reducing such errors.

A number of solutions to address the problems of banding errors already exist and these can reduce the visibility of the banding errors to a greater or lesser extent. For example, higher quality printing is normally carried out in multiple passes, partly to reduce the visibility of banding errors and partly to deposit less ink per swath, so that the paper does not become saturated with ink (which can cause the paper to warp). In such modes, the end nozzles of the pens print at more frequent intervals down the page (e.g. in the case of a ½ inch printhead the end nozzles would deposit ink every ¼ inch in a two-pass print mode or every 1/16 inch in an eight-pass print mode).

While this increases the frequency at which banding errors occur (since there are now e.g. twice as many bands or eight times as many bands), in fact it reduces the severity of each band, since a pixel lying at the top or bottom of a swath can be printed by either the nozzles at the top or bottom of the pen, or by the nozzles towards the middle of the pen. In a two-pass mode, each pixel has a 50% chance of being printed by either of two nozzles separated by a ¼ inch gap. In an eight-pass mode, the same pixel has a 12.5% chance of being printed by any one of 8 nozzles located at 1/16 inch intervals along the pen.

For these reasons, the droplets of ink deposited along the swath boundaries in multiple-pass modes are mixed with droplets printed from the middle of the pens during different passes, so that the visibility of the swath boundaries decreases.

Another approach to reducing swath boundaries is to stagger the individual pens relative to one another. This means that the swath boundaries from e.g. the cyan pen in a four-colour printer will be offset from the swath boundaries of the yellow, magenta and black pens (each of which are staggered from one another also). However, in printers used for high quality printing the print cartridges for each colour are separately mounted on a carriage (and thus a four colour carriage will have four printhead units located on it). Staggering the printheads on the carriage causes problems of balance as the carriage scans, particularly at high scan speeds, thus causing a degradation of image quality Another existing solution is to decrease the printing density from the ends of the printheads so that the amount of ink ejected from the end nozzles is relatively less than from the more central nozzles. The printing software defining the print mode causes the more central nozzles to deposit relatively more ink than the end nozzles in multiple-pass print modes and thereby reduce the ink density attributable to the swaths. In other words, the amount of ink which issues from the end nozzles during a print job is relatively less than would otherwise be expected, and the amount issuing from the more central nozzles relatively more, with the central nozzles compensating for the end nozzles during the multiple passes. However, this solution does not work for single pass print modes since there will be a necessity to print all of the image at certain positions on the page from the end nozzles only and thus the amount of ink issuing from these nozzles cannot be decreased. In most printers there is a need for both single-pass and multiple-pass print modes.

SUMMARY OF THE INVENTION

The invention provides a method of printing with a printer of the type which is adapted to receive a plurality of pens arranged to traverse a scan axis, each pen comprising an array of ink ejection elements, wherein the method comprises:

maintaining a first set of inactive ink ejection elements at one or both ends of one of said arrays during the printing of a swath, and maintaining a second set of inactive ink ejection elements at one or both ends of another of said arrays during the printing of the swath, whereby the first and second sets are selected such that the boundaries of the respective portions of the swath printed by the respective arrays are offset from one another in the PAD.

The method of the invention enables the swaths of ink to be laid down in a manner whereby the banding effects related to different swaths are offset from one another. In contrast, in prior art printing methods, the swath boundaries from each pen of a six-pen print carriage (for example) are aligned with and overlap one another. Any errors in end nozzle alignment or in the paper advance mechanism are reinforced by the fact that the swath boundaries from all of the pens are overlapping.

The method of the invention increases the print quality in two major ways. First, the banding errors from the different swaths do not reinforce one another since they lie on different points along the page, and second, the frequency of these (less noticeable) banding errors tends to be increased thereby reducing their noticeability to the human eye.

Preferably, the one array referred to above prints a swath in a first ink and the other array referred to above prints a swath in a second ink.

If each of the pens prints a swath of a different colour of ink, it is possible to offset the boundaries for two or more of the printed inks (preferably for all of the inks), so that the banding errors for each ink are distributed along the page.

In preferred embodiments, the arrays of ink ejection elements are substantially linear arrays of inkjet nozzles lying parallel to one another and each extending in the PAD between a first end and a second end.

Preferably, in one embodiment, the first ends of said linear arrays are aligned with one another along a line perpendicular to said PAD and the second ends of said linear arrays are aligned with one another along a line perpendicular to said PAD.

A significant advantage of this method of implementing the invention is that the invention can be implemented without any changes to the hardware (printer carriage, print cartridges, printheads, nozzle arrangements, etc.) used in the prior art, and thus it is inexpensive to implement, requiring only changes to the PC or print server software or to the printer firmware controlling the operation of the printer so that different sets of active nozzles (each of which can be thought of as providing a different "virtual pen") can be brought into play for each physical pen.

A further advantage of this is that the invention can be implemented for those print jobs for which higher quality is specified, and for lower quality print jobs the same hardware can be used in conventional manner to provide e.g. single pass printing with overlapping swath boundaries.

A compromise can also be reached between speed and quality by defining a print mode in which the active and inactive sets are defined for each pen (with at least two of the pens having different inactive sets of corresponding ink ejection elements), but printing in a single pass mode. As will be described below, this allows a significant reduction in banding effects to be observed with only a minor reduction in speed relative to the maximum speed at the print resolution chosen.

Most preferably, three or more arrays are used to print a corresponding number of swaths and a different set of nozzles at the first and/or second end of each array is inactive during the printing of the respective swath, whereby the boundaries of each swath are offset from one another in the PAD.

In the presently preferred embodiment described in detail below, all of the pens have different sets of active nozzles and no two swath boundaries coincide.

The invention has particular utility where the first ink and the second ink are of identical or of similar colours.

Thus, for example, if a printer has both dark and light hues of e.g. magenta or cyan ink, it is advantageous to offset the swath boundaries for these hues of the same basic colour, since the two inks are likely to be used together when printing a range of coloured pixels, and so the swath boundaries would otherwise reinforce one another. At a more general level, it is preferred to offset the swath boundaries of any two inks which, in a print job, are likely to be printed in close proximity to one another.

Thus, it is preferred that where the swath boundaries are offset for a pair of pens printing first and second inks, then the first ink and the second ink have different colours for which the respective hues as measured using the Hue, Saturation and Brightness (HSB) colour model differ by no more than 30 degrees, or most preferably are substantially identical (as for e.g. light and dark cyan).

In another aspect the invention provides a computer program product comprising printer control software for controlling a printer of the type which is adapted to receive a plurality of pens arranged to traverse a scan axis, each pen comprising an array of ink ejection elements, wherein the program comprises instructions effective to cause the printer to:

maintain a first set of inactive ink ejection elements at one or both ends of one of said arrays during the printing of a swath, and maintain a second set of inactive ink ejection elements at one or both ends of another of said arrays during the printing of the swath, whereby the first and second sets are selected such that the boundaries of the respective portions of the swath printed by the respective arrays are offset from one another in the PAD.

Further, preferably, the instructions further comprise means for converting a print job into a set of image masks, one for each pen, said image masks including means for compensating for the offset of the boundaries of the at least two offset swaths.

The computer program product may be embodied in the firmware of a printer, in a piece of software installed on a computer which controls the printer, or it may be split between both. In a typical embodiment the PC or print server will supply a file to be printed as e.g. a PostScript file (PostScript is a Trade Mark of Adobe Systems, Inc.), which is then processed by a raster image processor (RIP) within the printer to provide contone data for the pages to be printed. A halftoning ASIC processes the contone data to halftone data according to the inks available in the printer, and the halftone bitmap is sent to a printhead control ASIC which generates firing instructions to the individual printheads. The software which maintains the active and inactive nozzle sets will generally be embodied in the printhead control ASIC, optionally with reference to pre-configured print mode instructions which specify which nozzles should be activated in each pen for each print mode supported by the printer.

In another aspect the invention provides a printer comprising:

means for receiving a plurality of pens arranged to traverse a scan axis, each pen comprising an array of ink ejection elements adapted to print a swath on a printing medium, whereby a plurality of swaths can be printed simultaneously;

a printing medium advance mechanism for advancing the printing medium in increments past the pens in a printing advance direction (PAD) between the printing of a first plurality of swaths and a second plurality of swaths; and printer control circuitry for causing at least two of the pens to print from a different set of corresponding active ink ejection elements, whereby the swath boundaries printed by said at least two pens are offset from one in the printing medium advance direction.

In a further aspect the invention provides a printer comprising first and second pens arranged to traverse a print medium along a scan axis, the pens respectively comprising first and second arrays of printing elements each having a length extending along a second axis substantially perpendicular to the scan axis, at least one end of the first array being substantially aligned with the corresponding end of the second array in the second axis, the printer being arranged to simultaneously print first and second swaths of image content aligned with the scan axis with the first and second pens respectively, the first swath being of reduced width relative to the first pen length such that at least one boundary of the first swath is substantially offset along the second axis from the corresponding boundary of the second swath.

DETAILED DESCRIPTION OF THE PREFERRED EMBODIMENTS

There will now be described examples of the best mode contemplated by the inventors for carrying out the invention.

Figure 1:
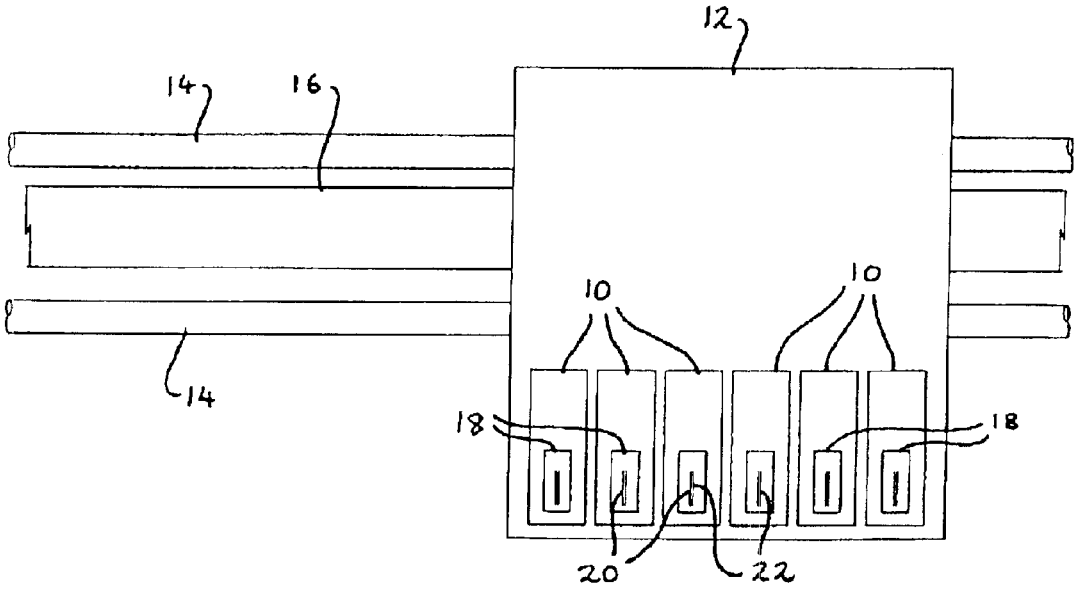
Fig. 1 (Prior Art)
FIG. 1 is a plan view of a prior art print carriage and associated print heads mounted on a pair of scan rails.

In FIG. 1 a conventional printhead is shown when printing with a preferred method of the invention with the only modification necessary being in the printer software or firmware.

Figure 2:
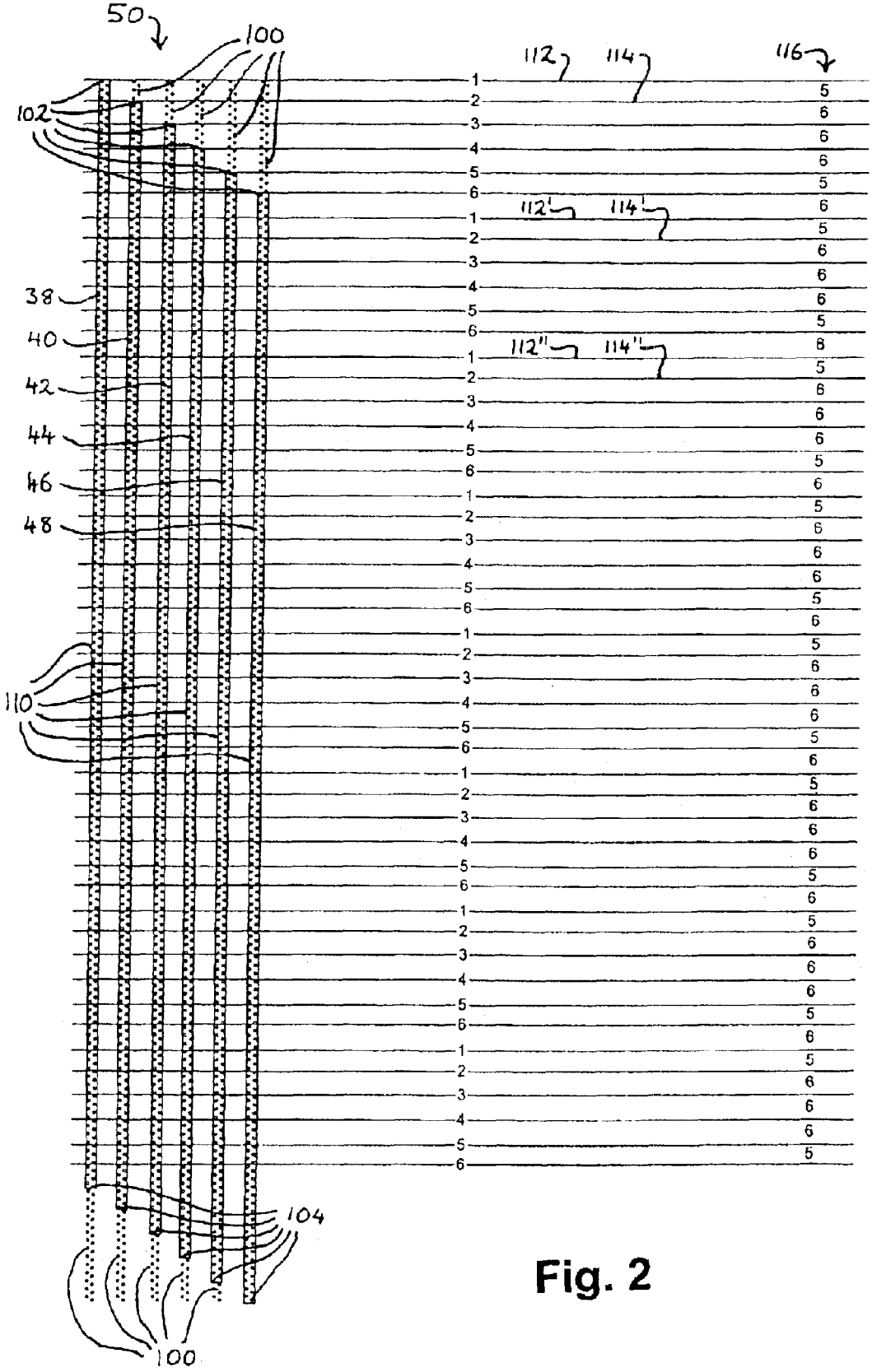
FIG. 2 is an enlarged view of a nozzle configuration of multiple pens illustrating an embodiment of an eight-pass method of printing according to the invention.

The nozzle configuration of FIG. 2 is a known array of six pens 38–48 each comprising two staggered rows of nozzles to give 300 nozzles per pen spaced at 1/600 inch intervals along the media axis. (The pens from left to right are a dark magenta pen 38, a dark cyan pen 40, a yellow pen 42, a light magenta pen 44, a light cyan pen 46 and a black pen 48.)

However, the nozzles are controlled by the printing software (which may be resident in a PC sending a print job to the printer, in a print server, or in the printer itself, for example) such that each pen has a set of inactive nozzles 100 at one or both ends of the pen and a set of active nozzles 110. In FIG. 2 the active nozzles 110 are enclosed in a rectangular box to distinguish them from the inactive nozzles. It can be thus seen that pen 38 has all of its inactive nozzles 100 at the bottom end 52 whereas pen 48 has all of its inactive nozzles 100 at the top end 50, and pens 40–46 have inactive nozzle sets 100 at both ends 50,52. Furthermore, in this embodiment each pen has a different set of active/inactive nozzles so that the active nozzle set 110 for each pen has a different "top nozzle" 102 and a different "bottom nozzle" 104.

The active nozzles are those nozzles which are activated by the printer software during scans of the page. In a first pass, the uppermost active nozzle 102 of dark magenta pen 38 scans along line 112. Line 112 is marked with the numeral "1" to indicate that it, like the corresponding lines 112' and 112", is the upper boundary of the first pen from the left during a pass across the page. Line 112' is the upper boundary along which the same topmost nozzle 102 of the dark magenta pen 38 runs during the second pass, and line 112" the upper boundary during the third pass.

Similarly, lines 114, 114' and 114" denote the upper boundary of the dark cyan pen 40 during the first, second and third passes (these lines are commonly marked with "2" to indicate pen number 2 from the left).

In the same way, the lines marked "3", "4", "5" and "6" show the upper boundaries of the yellow pen 42, light magenta pen 44, light cyan pen 46 and black pen 48, respectively, during each scan across the page.

A column of numbers 116 between the horizontal lines 112, 114, . . . indicates the interval (in units of 1 nozzle spacing or 1/600 inch) between the boundaries of the respective pens. Thus, the uppermost nozzles of pens 38 and 40 (as indicated by the lines marked "1" and "2" for each scan) are separated in the PAD by 5 nozzle spacings, the uppermost nozzles of pens 40 and 42 (as indicated by the lines marked "2" and "3" for each scan) are separated in the PAD by 6 nozzle spacings, and so on.

The top border of the swath laid down by the active nozzles of the black pen 48 in any pass (indicated by the lines marked "6") is offset from the top of the swath laid down by the active nozzles of the dark magenta pen 38 in the next pass (indicated by the lines marked "1") by 6 nozzle spacings.

In this way, any two adjacent swath boundaries on the printed media are separated by an interval of 5/600 or 6/600 inch along the PAD, making it very difficult for the eye to notice the boundaries. Furthermore, no two swath boundaries occur on top of one another, so banding errors are not reinforced.

It can be seen that the interval between any two successive passes of the same nozzle across the page are separated by 34/600 inches (the accumulation of the offsets of 5+6+6+6+5+6 nozzle spacings). The page is thus advanced in increments of 34/600 inches, and to ensure that the swath boundaries meet up after eight passes, each pen has a set of 8×34=272 active nozzles (enclosed by the boxes 110) with 28 inactive nozzles in each pen at one or both ends. In effect this means that for the embodiment shown in FIG. 2, each pen prints swaths of 272/600 inch height on each pass (containing ⅛ th of the pixels required in each unit area).

Although the print job will be marginally slower than with a full swath height of ½ inch, print speed is of less importance than print quality in high-pass print modes.

Since the hardware requires no modification to implement the FIG. 2 embodiment, the printer control software defining the print mode can implement the active/passive nozzle configuration of FIG. 2 (or some other active/passive nozzle configuration if required in terms of print quality), or can choose a conventional print mode for lower quality print jobs with higher throughput (i.e. to use the use the full height of the pens with all nozzles active). Of course, even in single-pass print modes, a slight reduction in printing speed may be a desirable trade-off for the reduction in banding errors achieved by preventing the swath boundaries of any two pens from overlapping. Indeed since swath boundaries are most noticeable in single-pass print modes, a very significant reduction in their visibility can be achieved by implementing the method of the invention, with an associated speed reduction of only approximately 10% (based on a swath height of 272 as opposed to 300 nozzles).

Figure 3:
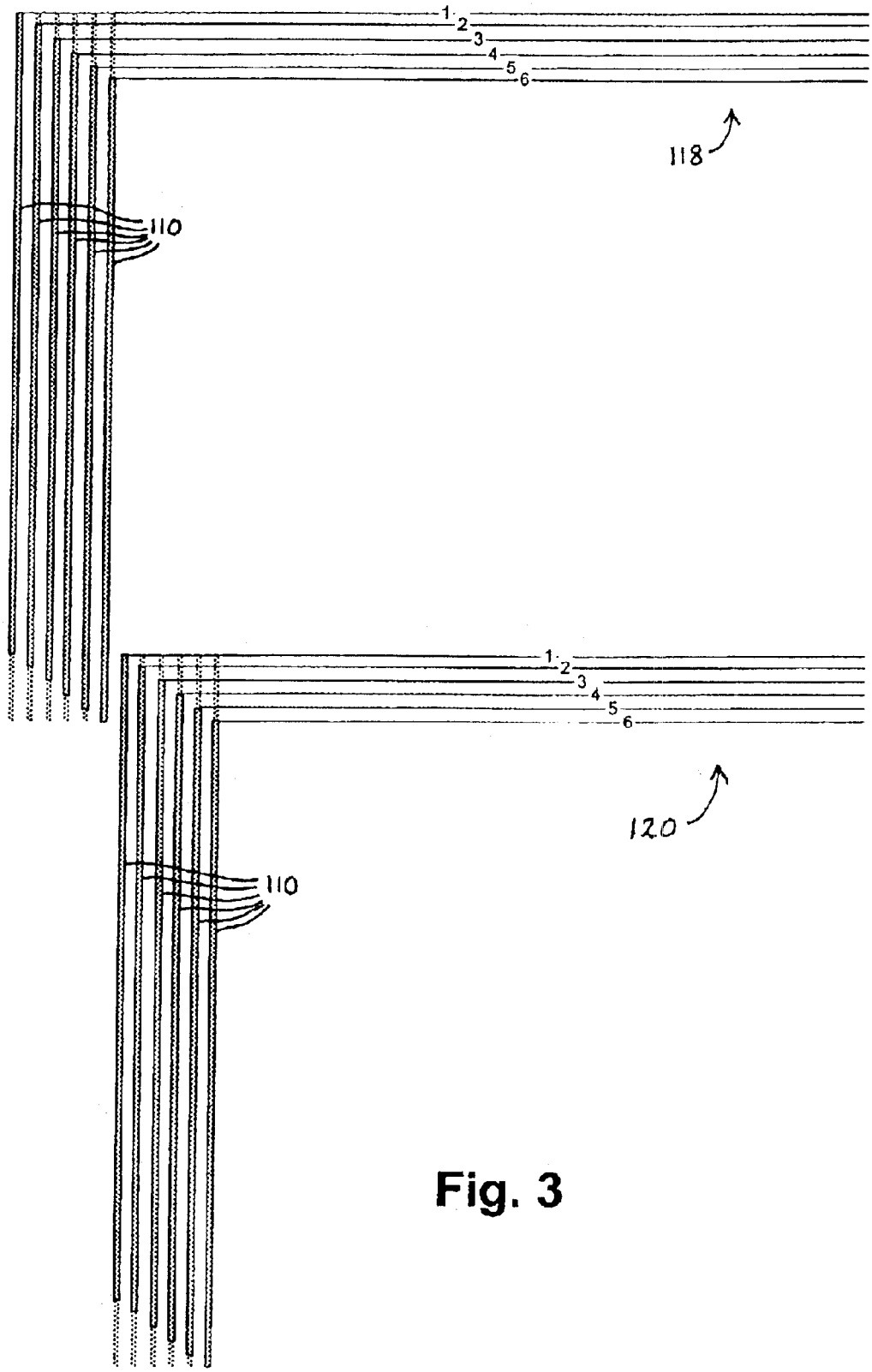
FIG. 3 is an enlarged view similar to that of FIG. 2 but illustrating an embodiment of a single-pass method of printing according to the invention.

FIG. 3 shows an embodiment of the method of the invention as applied to single-pass print modes. The same active/passive nozzle configuration is used, and in a first pass the tops of the active nozzle sets 110 traverse the lines 1, 2, 3, 4, 5 indicated at 118. For the next pass the paper is advanced by ½ inch and the tops of the active nozzles pass along the lines 1, 2, 3, 4, 5, 6 indicated generally at 120, i.e. along the lines traversed by the bottom of the active nozzle sets in the first pass. Thus, while the upper boundary of any given swath meets the lower boundary of the previous swath, the different swath boundaries for the various pens are offset from one another in the media axis direction.

While the best results are achieved by spreading the swath boundaries relatively equally down the page, the invention can be used to improve print quality by separating the swath boundaries by lesser amounts, or by allowing certain boundaries to overlap (e.g. rather than having six separate boundaries, the nozzle patterns for colour combinations such as yellow/black, light cyan/light magenta, and dark cyan/dark magenta could be common (i.e. could have the same boundaries, since these colour combinations may be less likely to reinforce one another). This would still lead to greatly improved print quality relative to a conventional print mode.

Furthermore, although the uppermost active nozzle 102 of the leftmost pen (shown as pen 38 in FIG. 2) is in fact the top end nozzle of the pen, and the lowermost active nozzle 104 of the right-most pen (48 in FIG. 2) is the bottom end nozzle of that pen, the skilled person will appreciate that the sets of active nozzles 110 and inactive nozzles 100 can be defined by the printer control software to ensure that there are at least a minimum number of inactive nozzles at both ends of each pen, if it is preferred that the end nozzles should never be used for printing due to concerns over the directionality of droplets issuing from the end nozzles of the pens.

The invention is not limited to the embodiments specifically described herein which may be modified or varied without departing from the scope of the invention as defined in the accompanying claims.

What is claimed is:

1. A method of printing with a printer of the type which is adapted to receive a plurality of pens arranged to traverse a scan axis, each pen comprising an array of ink ejection elements, wherein the method comprises:

mantaining a first set of inactive ink ejection elements at one or both ends of one of said arrays during the printing of a swath, and maintaining a second set of inactive ink ejection elements at one or both ends of another of said arrays during the printing of the swath, whereby the first and second set are selected such that the boundaries of the respective portions of the swath printed by the respective arrays are offset from one another in a printing advance direction (PAD), wherein said one array prints a swath in a first ink and wherein said another array prints a swath in a second ink, and wherein the first ink and the second ink are of identical or of similar colours.

2. A method as claimed in claim 1, wherein said arrays of ink ejection elements are substantially linear arrays of inkjet nozzles lying parallel to one another and each extending in the PAD between a first end and a second end.

3. A method as claimed in claim 2, wherein the first ends of said linear arrays are aligned with one another along a line perpendicular to said PAD and the second ends of said linear arrays are aligned with one another along a line perpendicular to said PAD.

4. A method as claimed in claim 1, wherein three or more arrays are used to print a corresponding number of swaths and wherein a different set of nozzles at the first and/or second end of each array is inactive during the printing of the respective swath, whereby the boundaries of each swath are offset from one another in the PAD.

5. A method of printing with a printer of the type which is adapted to receive a plurality of pens arranged to traverse a scan axis, each pen comprising an array of ink ejection elements, wherein the method comprises:

maintaining a first set of inactive ink ejection elements at one or both ends of one of said arrays during the printing of a swath, and maintaining a second set of inactive ink ejection elements at one or both ends of another of said arrays during the printing of the swath, whereby the first and second sets are selected such that the boundaries of the respective portions of the swath printed by the respective arrays are offset from one another in a printing advance directions (PAD), wherein said one array prints a swath in a first ink and wherein said another array prints a swath in a second ink, and wherein the first ink and the second ink have different colours for which the respective hues as measured using the Hue, Saturation and Brightness (HSB) colour model differ by no more than 30 degrees.

6. A method as claimed in claim 5, wherein said arrays of ink ejection elements are substantially linear arrays of inkjet nozzles lying parallel to one another and each extending in the PAD between a first end and a second end.

7. A method as claimed in claim 6, wherein the first ends of said linear arrays are aligned with one another along a line perpendicular to said PAD and the second ends of said linear arrays are aligned with one another along a line perpendicular to said PAD.

8. A method as claimed in claim 5, wherein three or more arrays are used to print a corresponding number of swaths and wherein a different set of nozzles at the first and/or second end of each array is inactive during the printing of the respective swath, whereby the boundaries of each swath are offset from one another in the PAD.

9. A method of printing with a printer of the type which is adapted to receive a plurality of pens arranged to traverse a scan axis, each pen comprising an array of ink ejection elements, wherein the method comprises:

maintaining a first set of inactive ink ejection elements at one or both ends of one of said arrays during the printing of a swath, and maintaining a second set of inactive ink ejection elements at one or both ends of another of said arrays during the printing of the swath, whereby the first and second sets are selected such that the boundaries of the respective portions of the swath printed by the respective arrays are offset from one another in a printing advance direction (PAD).

wherein said one array prints a swath in a first ink and wherein said another array prints a swath in a second ink, and wherein the first ink and the second ink have different colours for which the respective hues as measured using the Hue, Saturation and Brightness (HSB) colour model are effectively identical.

10. A method as claimed in claim 9, wherein said arrays of ink ejection elements are substantially linear arrays of inkjet nozzles lying parallel to one another and each extending in the PAD between a first end and a second end.

11. A method as claimed in claim 10, wherein the first ends of said linear arrays are aligned with one another along a line perpendicular to said PAD and the second ends of said linear arrays are aligned with one another along a line perpendicular to said PAD.

12. A method as claimed in claim 9, wherein three or more arrays are used to print a corresponding number of swaths and wherein a different set of nozzles at the first and/or second end of each array is inactive during the printing of the respective swath, whereby the boundaries of each swath are offset from one another in the PAD.

13. A computer program product comprising printer control software for controlling a printer of the type which is adapted to receive a plurality of pens arranged to traverse a scan axis, each pen comprising an array of ink ejection elements, wherein the program comprises instructions effective to cause the printer to:

maintain a first set of inactive ink ejection elements at one or both ends of one of said arrays during the printing of a swath using a first ink, and maintain a second set of inactive ink ejection elements at one or both ends of another of said arrays during the printing of the swath using a second ink, and select the first and second sets such that the boundaries of the respective portions of the swath printed by the respective arrays are offset from one another in the PAD, and wherein the first ink and the second ink have one of;

identical or of similar colours;

different colours for which the respective hues as measured using the Hue, Saturation and Brightness (HSB) colour model differ by no more than 30 degrees; and different colours for which the respective hues as measured using the Hue, Saturation and Brightness (HSB) colour model are effectively identical.

14. A computer program product as claimed in claim 13, wherein said instructions further comprise means for converting a print job into a set of image masks, one for each pen, said image masks including means for compensating for the offset of the boundaries of the at least two offset swaths.

15. A computer program product as claimed in claim 13, when embodied in the firmware of a printer.

16. A computer program product as claimed in claim 13, when embodied in a piece of software installed on a computer which controls the printer.

17. A printer comprising:

means for receiving a plurality of pens arranged to traverse a scan axis, each pen comprising an array of ink ejection elements adapted to print a swath on a printing medium, whereby a plurality of swaths can be printed simultaneously;

a printing medium advance mechanism for advancing the printing medium in increments past the pens in a printing advance direction (PAD) between the printing of a first plurality of swaths in a first ink and a second plurality of swaths in a second ink; and printer control circuitry for causing at least two of the pens to print from a different set of corresponding active ink ejection elements, whereby the swath boundaries printed by said at least two pens are offset from one in the printing medium advance direction, and wherein the first ink and the second ink have one of;

identical or of similar colours;

different colours for which the respective hues as measured using the Hue, Saturation and Brightness (HSB) colour model differ by no more than 30 degrees; and different colours for which the respective hues as measured using the Hue, Saturation and Brightness HSB colour model are effectively identical.

18. A printer comprising first and second pens arranged to traverse a print medium along a scan axis, the pens respectively comprising first and second arrays of printing elements each having a length extending along a second axis substantially perpendicular to the scan axis, at least one end of the first array being substantially aligned with the corresponding end of the second array in the second axis, the printer being arranged to simultaneously print first and second swaths of image content aligned with the scan axis with the first and second pens respectively, the first swath being printed in a first ink and of reduced width relative to the first pen length such that at least one boundary of the first swath is substantially offset along the second axis from the corresponding boundary of the second swath which is printed in a second ink, and wherein the first ink and the second ink have one of;

identical or of similar colours;

different colours for which the respective hues as measured using the Hue, Saturation an Brightness (HSB) colour model differ by no more than 30 degrees; and different colours for which the respective hues as measured using the Hue, Saturation and Brightness (HSB) colour model are effectively identical.

* * * * *